US006655418B1

(12) United States Patent
McGill et al.

(10) Patent No.: US 6,655,418 B1
(45) Date of Patent: Dec. 2, 2003

(54) DROP TUBE SEAL FOR PETROLEUM UNDERGROUND STORAGE TANKS

(76) Inventors: Milton Daniel McGill, 1579 Hidden Canyon Rd., La Habra Heights, CA (US) 90631; Thompson William Wyper, 1159 W. Fern Dr., Fullerton, CA (US) 92833

( * ) Notice: Subject to any disclaimer, the term of this patent is extended or adjusted under 35 U.S.C. 154(b) by 31 days.

(21) Appl. No.: 10/020,690

(22) Filed: Oct. 29, 2001

Related U.S. Application Data

(60) Provisional application No. 60/243,954, filed on Oct. 27, 2000.

(51) Int. Cl.[7] ..... B65B 31/00

(52) U.S. Cl. ..... 141/1; 141/86; 141/98; 141/301; 141/4

(58) Field of Search ..... 141/1, 2, 7, 4, 141/86.88, 285, 301, 98, 374, 198; 138/97, 114; 405/53, 184.1

(56) References Cited

U.S. PATENT DOCUMENTS 5,887,614 A * 3/1999 Weeks et al. ..... 137/421
6,206,056 B1 * 3/2001 Lagache ..... 141/198
6,267,156 B1 7/2001 Argandona ..... 141/86

OTHER PUBLICATIONS

Booklet—"Executive Order VR–101–A Phil–Tite Phase 1 Vapor Recovery System For Gasoline Dispensing Facilities", State of California Air Resources Board (Includes 5 Exhibits), Jun. 19, 2001.

* cited by examiner

*Primary Examiner*—Gregory L. Huson
*Assistant Examiner*—Peter deVore
(74) *Attorney, Agent, or Firm*—Christie, Parker & Hale LLP

(57) ABSTRACT

A drop tube sealing assembly may contain a riser pipe having a proximal end with internal threads and an underground storage tank spaced apart from the proximate end of the riser pipe. The storage tank may contain a threaded inlet which is positioned atop the tank. A pipe nipple may include a first end in cooperation with the proximal end, an opposite end in cooperation with the threaded inlet, and an annular inner surface that forms a conduit. The inner surface may comprise a female thread section. A drop tube adapter fitting may be concentrically disposed within the pipe nipple. The adapter fitting may contain an outer surface containing external threads in cooperation with the female thread section. A seal in the form of an O-ring may be disposed between the adapter fitting and the pipe nipple. A drop tube having a open end may be coupled to the adapter fitting.

15 Claims, 7 Drawing Sheets

DROP TUBE SEAL FOR PETROLEUM UNDERGROUND STORAGE TANKS

CROSS-REFERENCE TO RELATED APPLICATION(S)

This application claims priority to the U.S. provisional application No. 60/243,954, filed Oct. 27, 2000.

FIELD OF THE INVENTION

The present invention generally relates to underground storage tanks for storing gasoline dispensed at filling stations and, more particularly, to an underground storage tank unit having a drop tube sealing system for preventing the escape of underground storage tank ullage vapors.

BACKGROUND

During the filling of underground storage tanks (UST's) for fuel, as shown in FIG. 1, a tanker truck generally delivers fuel to a fill riser 26 through a fill adaptor 20 and direct fill spill containment bucket 24. The spill containment bucket is connected to a riser pipe 28 that extends from the top of the underground tank 30. Fuel is delivered from the fuel tanker to the fill riser via a fuel duct that attaches to top of the fill riser. A tube 32 (herein referred to as a "drop tube") that extends from the top of the fill riser to location below the stored fuel level 40 is used to prevent fuel entering the UST from splashing and agitating liquid fuel stored within the tank. The drop tube is concentrically disposed within the fill riser and riser pipe such that an annular channel 37 is formed between them. The annular channel routes any excess fuel that is spilled from the top of the fill riser into the containment bucket to the UST via a drain channel 39 coupled between the bucket floor and the riser pipe. A poppet drain valve 35 disposed in the containment bucket allows the excess fuel to pass through the drain channel. An O-ring seal 36 is provided between the top of the fill riser and the fill adaptor to prevent fuel vapor from rising along the annular channel to the top of the fill riser and escaping into the atmosphere.

Filing stations typically utilize a vapor recovery system to capture fuel vapors being displaced from a customer's tank by the fuel being added to the vehicle tank. Such systems provide a partial vacuum to draw excess fuel vapor from the customer's tank and route them back to the station's underground tanks. The captured fuel vapors cause fuel vapor pressure changes in the UST ullage space. As a result, the UST may become pressurized by the cumulative effects of the vapors produced therein, and the sloshing and agitation of the stored fuel during filling of the tank.

The higher pressure in the UST ullage space often causes emission of vapors through the annular channel 37 which may leak through defective seals and fittings associated with the spill containment bucket assembly. Additionally, the fumes and vapor pressure that rise from the UST within the annular passage may prevent drainage of excess fluid from the containment bucket, particularly when the fuel is warmed, such as on hot summer days. The drain valve at the containment box is effectively inoperative when excess pressure is exerted on the valve from below. Further, since the spill containment bucket may be exposed to the surface, such as when a manhole cover 22 sealing the containment bucket is removed, often dirt and other foreign matter degrade the seal in the drain valve unit. This problem is exacerbated in sites that use remote UST fills since the entire remote fill piping and spill bucket are exposed to the UST ullage vapors.

Attempts have been made to solve a portion of the problem. In one example, the seal between the drop tube and the riser pipe is re-located from atop the intake tube to a location along the riser pipe, just below the containment bucket. While this system has been helpful in preventing vapors from emitting to the atmosphere through the direct fill containment bucket, fuel vapors are still capable of escaping to the atmosphere through piping connected to remote fill spill bucket assemblies.

Thus, there is a need for a drop tube sealing assembly which helps prevent any of the UST ullage vapors from escaping out of either the direct or remote fill spill bucket assemblies. Such an assembly should be adapted to be easily installed in existing USTs.

SUMMARY OF THE INVENTION

The present invention is generally directed to drop tube sealing assembly for sealing direct and remote spill containment buckets, and associated assemblies, from an underground tank ullage vapor pressure. In one embodiment, the drop tube sealing assembly includes a riser tube having a proximal end with internal threads and an underground storage tank spaced apart from the proximate end of the riser tube. The storage tank contains a threaded inlet which is positioned atop the tank. A standard pipe nipple includes a first end in cooperation with the proximal end, an opposite end in cooperation with the threaded inlet, and an annular inner surface that forms a conduit. The inner surface comprises a female thread section. A drop tube adapter fitting is concentrically disposed within the pipe nipple. The adapter fitting contains an outer surface containing external threads in cooperation with the female thread section. A seal in the form of an O-ring is disposed between the adapter fitting and the pipe nipple. A drop tube having a open end is coupled to the adapter fitting.

The present invention provides an improved method and device for containing underground tank ullage vapor pressure that generally enter the direct and remote spill containment buckets, and associated assemblies.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

In one embodiment of the present invention, there is provided a drop tube seal assembly for sealing direct and remote spill containment buckets, and associated assemblies, from an underground tank ullage vapor pressure. For the purpose of describing the present invention, the term "direct fill" will relate to any components directly connected to the riser pipe (i.e., riser pipe 70 in FIG. 2) extending from the UST, and the term "remote fill" will relate to any fill port or other component indirectly connected to the riser pipe extending from the UST, for example, by a pipe tee fitting.

Figure 1:
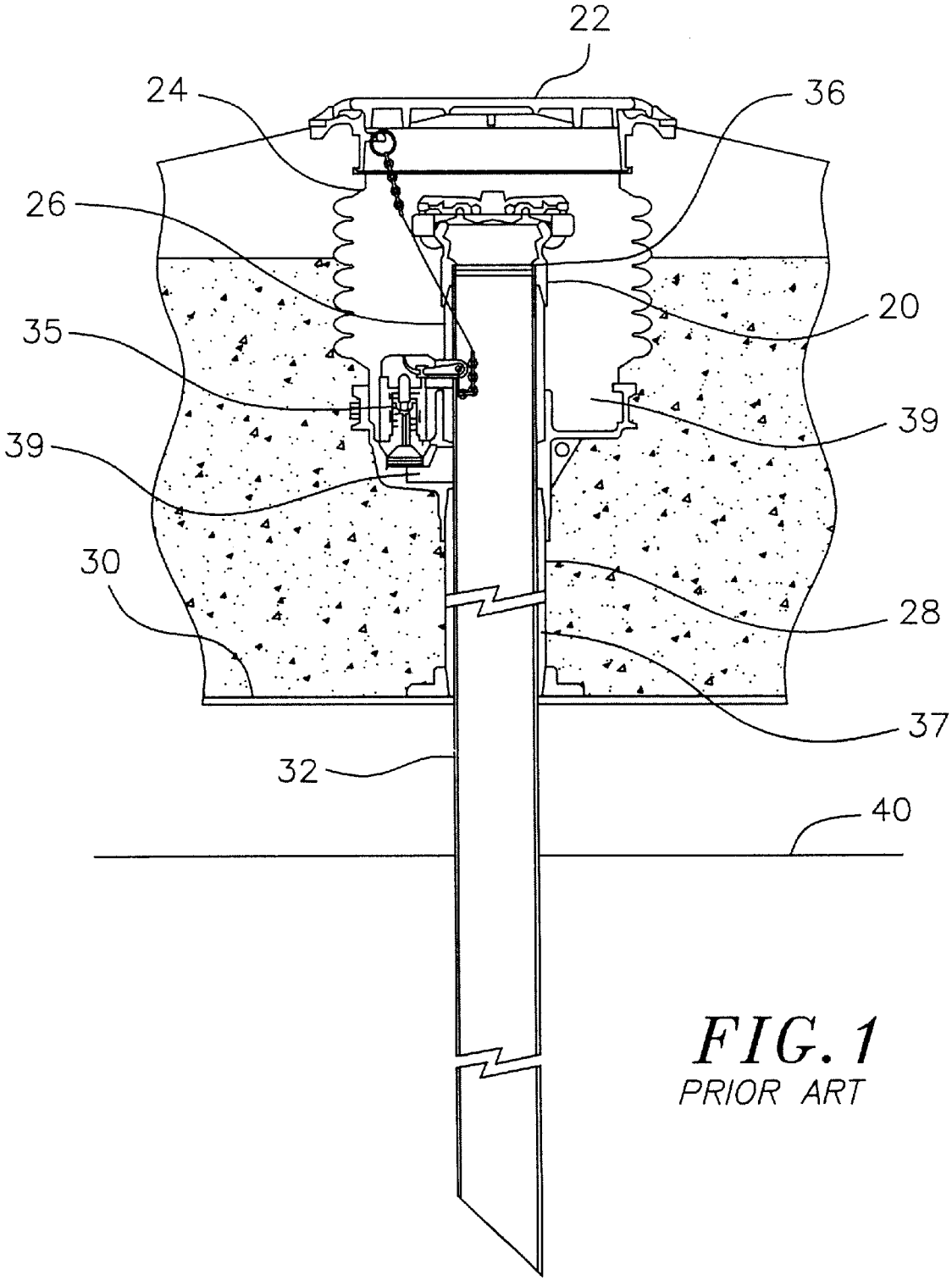
FIG. 1 PRIOR ART
FIG. 1 is schematic of an underground storage tank unit of the prior art.
Figure 2:
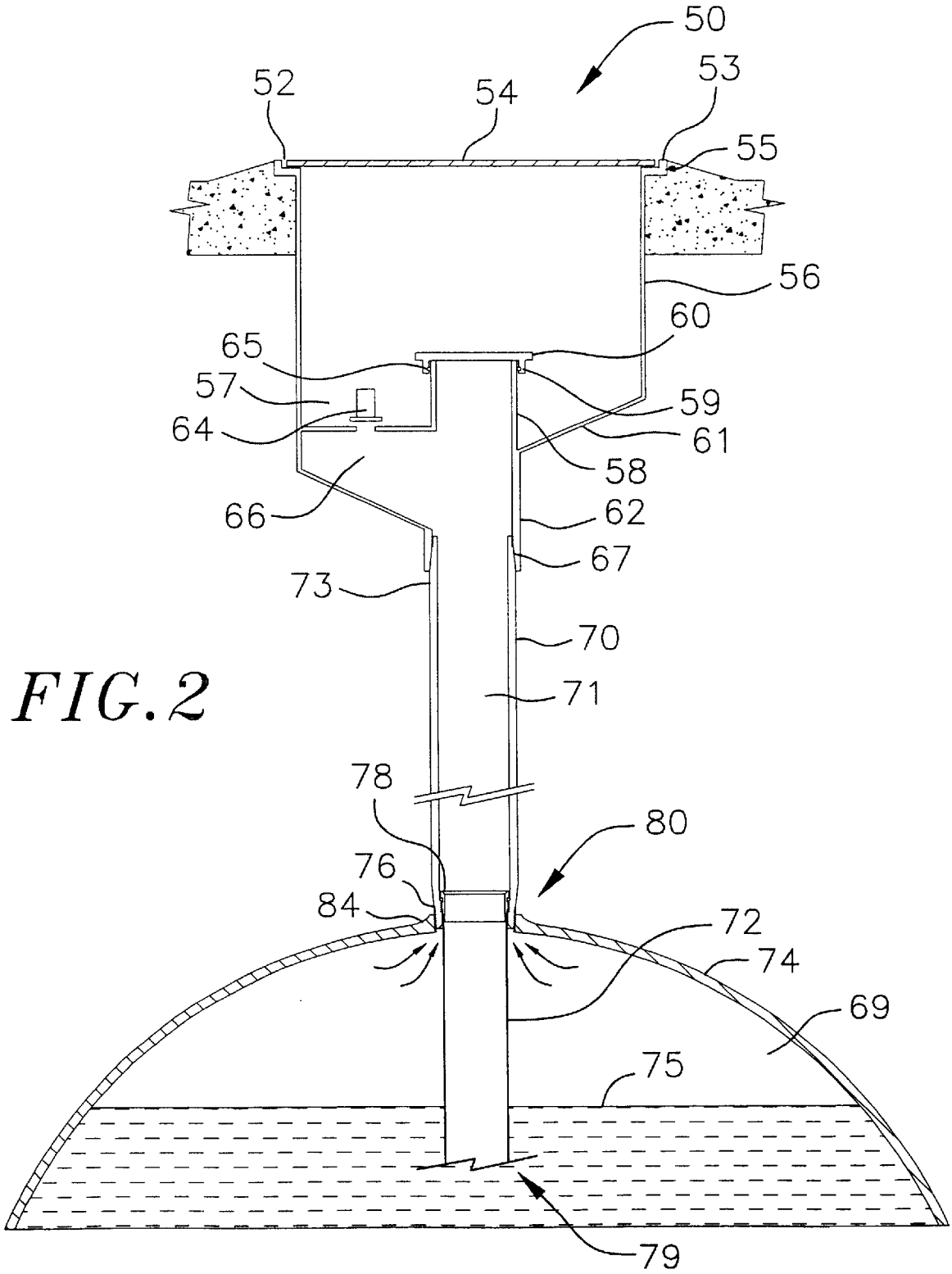
FIG. 2 is a schematic of an underground storage tank unit incorporating a drop tube seal system according to one embodiment of the present invention.

As shown in FIG. 2, a drop tube seal assembly 80 is incorporated into an underground fuel storage unit 50 comprising a direct fill spill containment bucket 56 connected to a riser pipe 70 extending from the top of an underground fuel storage tank or UST 74. The spill containment bucket is installed within a fill port or manhole 52 and includes an open top 53 for receiving gasoline. The UST in this example contains gasoline and is located directly below the spill containment bucket. A drop tube 72 concentrically disposed within the riser pipe extends into the fuel storage tank to a location below the liquid fuel level. A seal 80 is provided between the drop tube and the riser pipe at a location proximate the top of the storage fuel tank to help prevent the fuel vapors from escaping the UST and migrating into either direct or remote fuel spill bucket assemblies.

The spill containment bucket 56 may be of annular construction and adapted to sit within a manhole. The containment bucket may be made from fiberglass-reinforced plastic (FRP), stainless steel or any other corrosion-resistant material, and may include an open top 53 having a shoulder 55 for receiving a manhole cover 54. The containment bucket may also include a generally slanted floor 61 for draining spilled gasoline into a trough 57. However, it should be understood that the particular spill bucket design is not part of the present invention, which can be used advantageously with any spill bucket. Indeed, the present invention can be used with a wide variety of above ground fuel sources for underground tanks.

Coupled to the slanted floor 61 may be a generally cylindrical fuel intake tube 58 having an inlet end 65 upwardly extending from the floor into the containment bucket interior and an outlet end 67 downwardly extending from the floor towards the UST. The fuel intake pipe generally passes fuel from a fuel tanker truck to the riser pipe 70 through its annular interior. Instrumentation for passing gasoline from the fuel tanker to the storage tank unit, such as a fuel duct, is typically fastened to the intake tube at the inlet end. A fill cap 60 may be secured to the inlet end to seal the fuel intake tube during non-use to prevent any dirt or debris from falling into the UST. The inner surface of the outlet end may be threaded to receive a male threaded end of the riser pipe.

A drain valve 64 disposed in the trough 57 allows the drainage of gasoline passing from the containment bucket 56 into a fluid channel 66 in communication with the outlet end of the intake pipe. In a preferred embodiment, the drain valve is actuated by the lifting of the fill lid or manhole cover. In an alternative embodiment, the drain valve is actuated by a manually operated lever, but the drain valve may comprise any suitable mechanical valving mechanism.

The riser pipe 70 is a generally annular tube that extends between the outlet end 67 of the containment bucket 56 and the underground storage tank 74. The riser pipe may be constructed from FRP, stainless steel, steel, aluminum or other suitable material. The riser pipe includes a distal end 73 that is externally threaded for engaging the internal threads of the outlet end 67, and a proximal end 76 that is internally threaded for receiving one end of a standard pipe nipple coupled to the UST. The annular inner wall of the riser tube defines a main fuel line 71 for passing fuel from the intake tube 58 to the UST.

The underground storage tank or UST 74 is a generally spherical drum comprising a cavity 69 for storing fuel and a tank inlet 84 disposed at the top of the UST. The UST may be formed from FRP, steel or any other suitable material. The cavity contains fuel to a level indicated at 75. The tank ullage contains fuel vapors at partial pressure equilibrium. The tank inlet 84 upwardly extends a short distance above the top of the UST and includes an internally threaded bore 85 (FIG. 3) for receiving an opposite end of the standard pipe nipple coupled the riser pipe 70.

Figure 3:
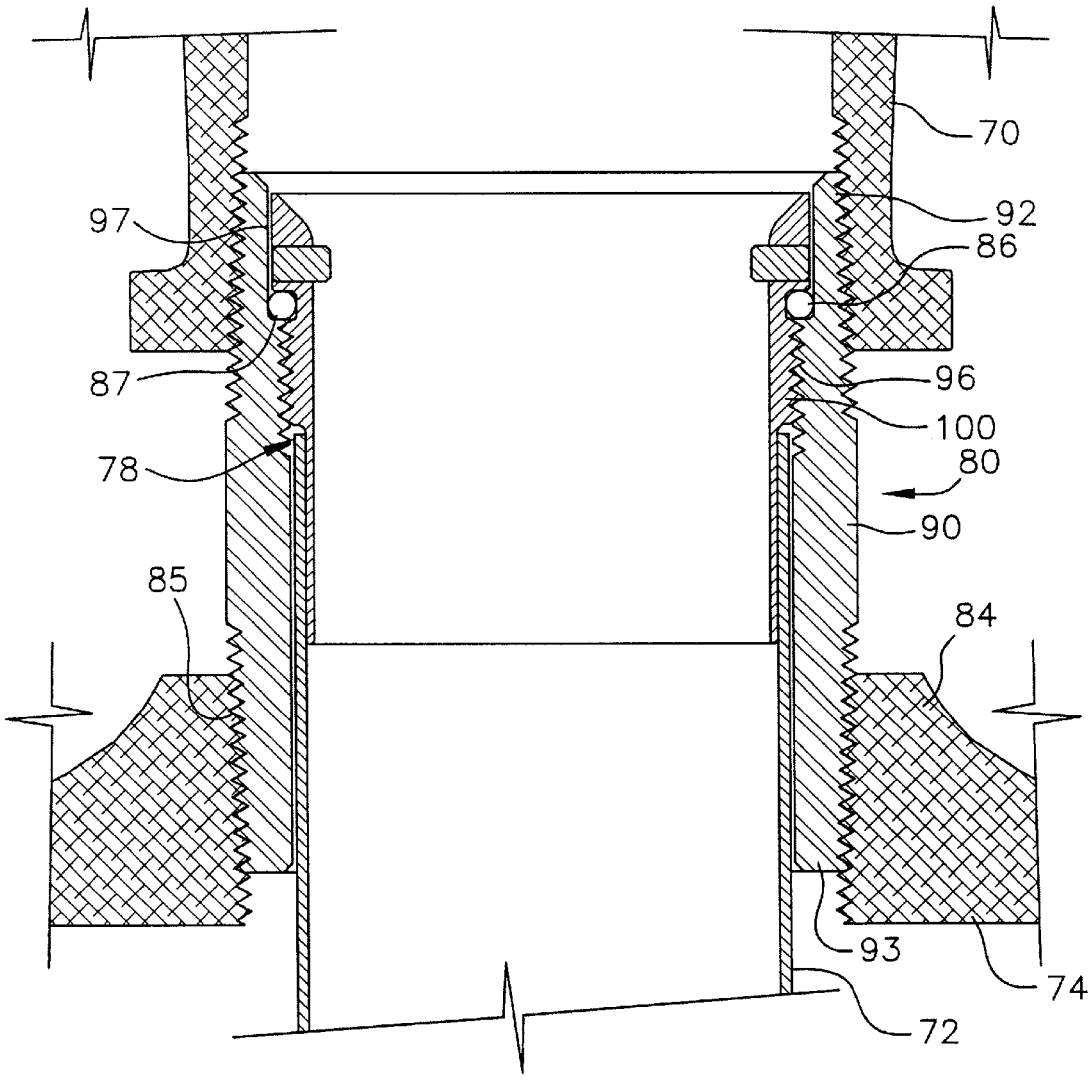
FIG. 3 is a partial cross-section side view illustrating a drop tube seal assembly according to one embodiment of the present invention.
Figure 4:
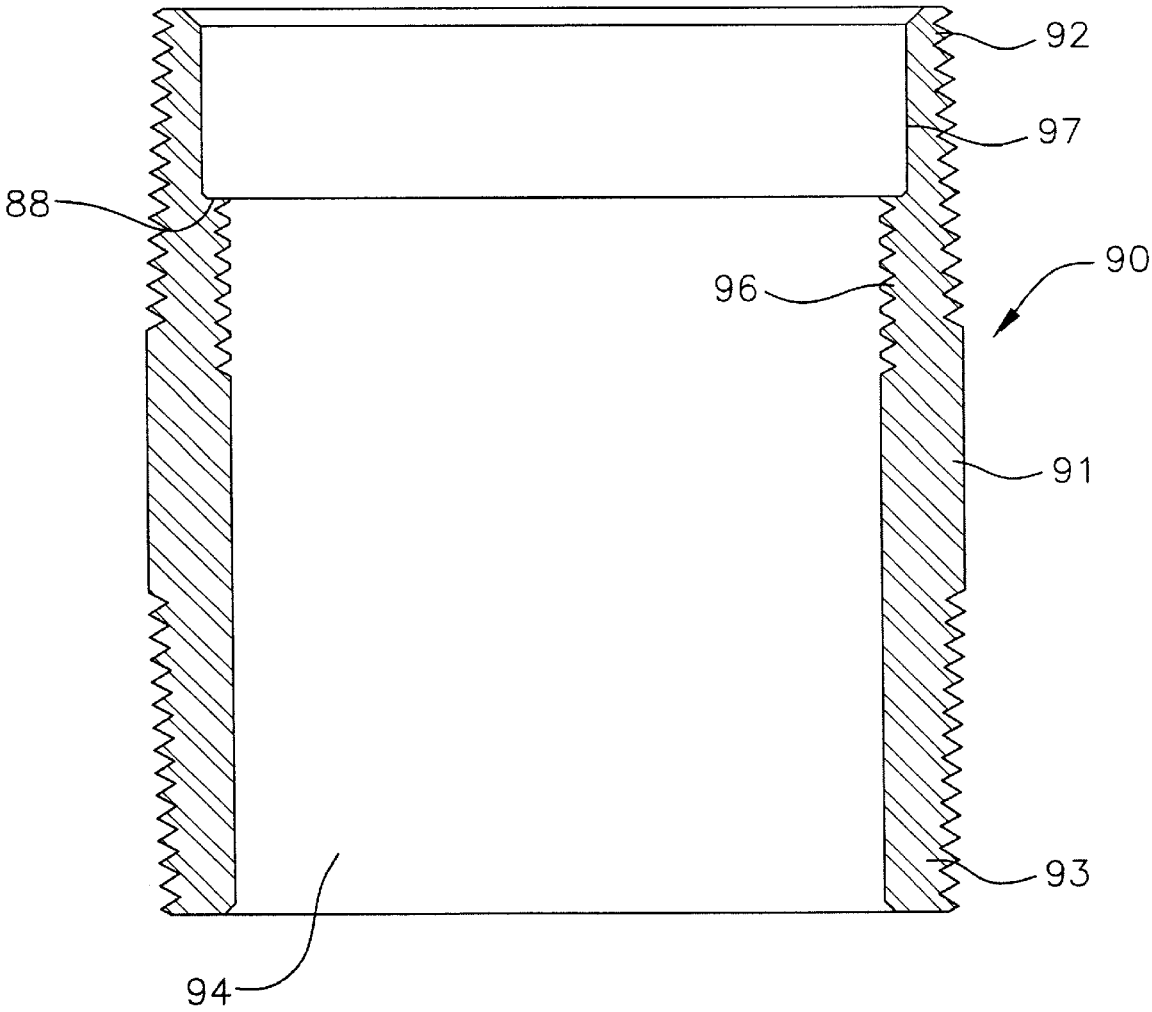
FIG. 4 is a cross-sectional side view of a standard pipe nipple of the drop tube seal assembly in FIG. 3.

As shown in FIG. 3, a drop tube seal assembly 80 couples the riser pipe with UST 74. The seal assembly generally comprises a standard pipe nipple 90, a drop tube adaptor fitting 100, and a drop tube 72. As depicted in FIG. 4, the pipe nipple is a standard 4 inch NPT pipe nipple comprising generally annular central body 91 disposed between a first longitudinally extending nipple end 92 and a second longitudinally extending nipple end 93. The pipe nipple is preferably made from ASTM A-106 {Steel}, A-53 4"SCH 120 or 160 pipe, or other suitable material. The central body preferably has a nominal outer diameter of about 4.5 inches and a nominal inner diameter preferably of about 3.6 inches. The pipe nipple preferably spans longitudinally about 5.0 inches in length.

The first end 92 has externally tapered threads that cooperate with the internal threads of the riser tube proximal end 76, and similarly, the second end 93 has externally tapered threads that cooperate with the internal thread of the bore 85 at the tank inlet 84. The annular construction of the pipe nipple defines a conduit 94 longitudinally extending through the fitting interior.

The first end 92 is additionally defined by a counterbore 97 preferably having dimensions of about 3.9 inches in diameter, and a female thread section 96 extending along the inner diameter of the adaptor fitting between the counterbore and the central body 91.

Figure 5:
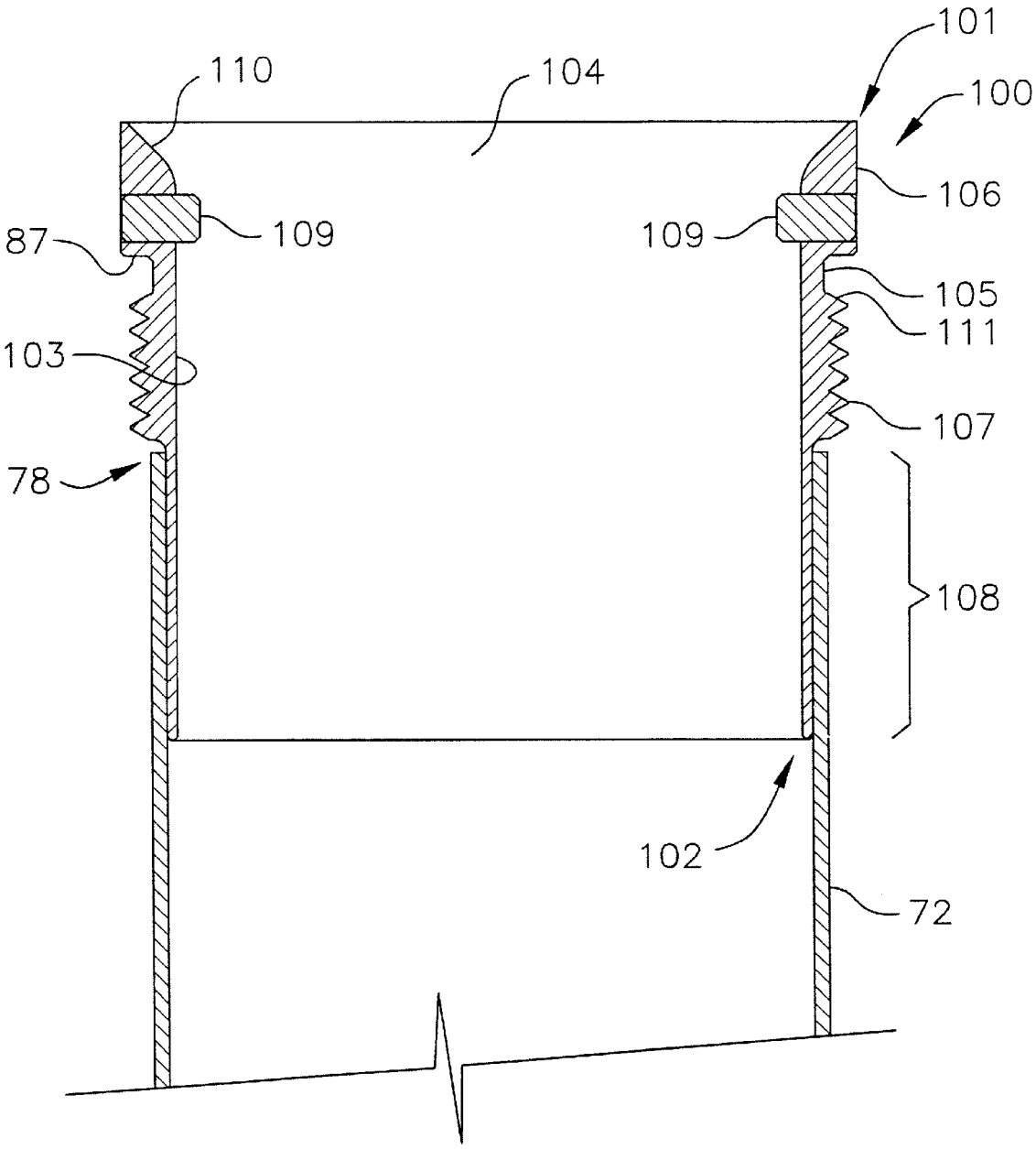
FIG. 5 is a cross-sectional side view of a drop tube adaptor fitting and drop tube of the drop tube assembly in FIG. 3.

Referring to FIG. 5, the drop tube adaptor fitting 100 is generally cylindrical in shape and extends between an upper end 101 and a lower end 102. The adaptor fitting is preferably made from cast iron, 300 Series stainless steel, bronze or any other corrosion-resistant material. The adaptor fitting also includes an inner surface 103 and an outer surface 111. The inner surface defines an orifice 104 whereby fluid passes from the main fluid passage 71 to the drop tube interior. The interior surface is chamfered 110 at the upper end to condition the flow of fluid passing through the orifice and minimize flow disturbances during fuel delivery events.

The outer surface 111 contains a land 106 at the upper end 101. The land is generally dimensioned to mate with the counterbore 97 of the pipe nipple. A pair of installation pins 109 are disposed along the inner diameter of the land at diametrically opposed locations. The installation pins are press fit into the land 106 such that they inwardly extend into the orifice 104. The installation pins cooperate with indexing slots of an installation tool to assemble the drop tube adaptor fitting withing the drop tube sealing system during installation.

The outer surface 111 further includes a machined O-ring grove 105 that is disposed between the land and an external thread portion 107. The outer surface is machined to a reduced nominal outer diameter in an outer bond surface region 108 proximate the lower end 102. The outer bond surface is preferably tapered with a coarse screw traced finished and machined to dimension corresponding to the interior diameter of the drop tube 72. In preferred embodiments, the interior surface of a top portion of the drop tube is bonded to the outer surface of the drop tube adaptor fitting along the bond region. The bonding surface area between the drop tube and the adaptor fitting is preferably about 14 square inches. The adaptor fitting may be bonded to the drop tube by, for example, an epoxy adhesive. The drop tube may also be welded to the fitting.

As illustrated in FIG. 3, the drop tube adaptor fitting 100 can be assembled to the pipe nipple 90 by engaging the threaded portion 107 with the female thread section 96 of the first end 92. An annular shoulder 88 (FIG. 4) defined by the counterbore 97 cooperates with an O-ring 86 which fits snugly within the O-ring groove 105 to effect a positive seal between the drop tube 72 and the riser pipe 70. The land 101 provides an O-ring sealing surface 87 (FIG. 5) which acts to compress the O-ring against the annular shoulder when the threaded portion is further engaged with the female thread section. The O-ring is preferably made from a chemically resistant fluorocarbon elastomer, such as Viton®. The seal prevents fuel ullage vapors rising along the drop tube from escaping into the riser pipe and thereby into the direct fill containment bucket.

The drop tube 72 of the present invention is partially depicted in FIGS. 2, 3, 5 and 7. The drop tube includes a open end 78 that is coupled to the adaptor fitting 100, a submerged end 79 (FIGS. 2 and 7) positioned at a desired location in the UST below the fluid level 75, and an annular wall 77 axially extending downwards from the open end to the submerged end. The drop tube may be formed from aluminum, stainless steel, and more preferably, FRP, or any other material suitable for resisting corrosion. The annular wall 77 forms a fluid passage 95 for passing fuel from the riser pipe 70 to the UST 74 and is preferably dimensioned to a nominal diameter of about 3.5 inches.

The drop tube 72 is preferably assembled to the drop tube adaptor fitting 100 by press fitting the lower end 102 of the adaptor fitting into the open end 78 of the drop tube 72 and then bonding or welding it in place. The adaptor fitting may be bonded to the drop tube by applying an adhesive, for example, an epoxy adhesive, to the bond surface 108. In alternative embodiments, the drop tube may be fixed to the drop tube fitting, for example, by welding and the like.

Figure 7:
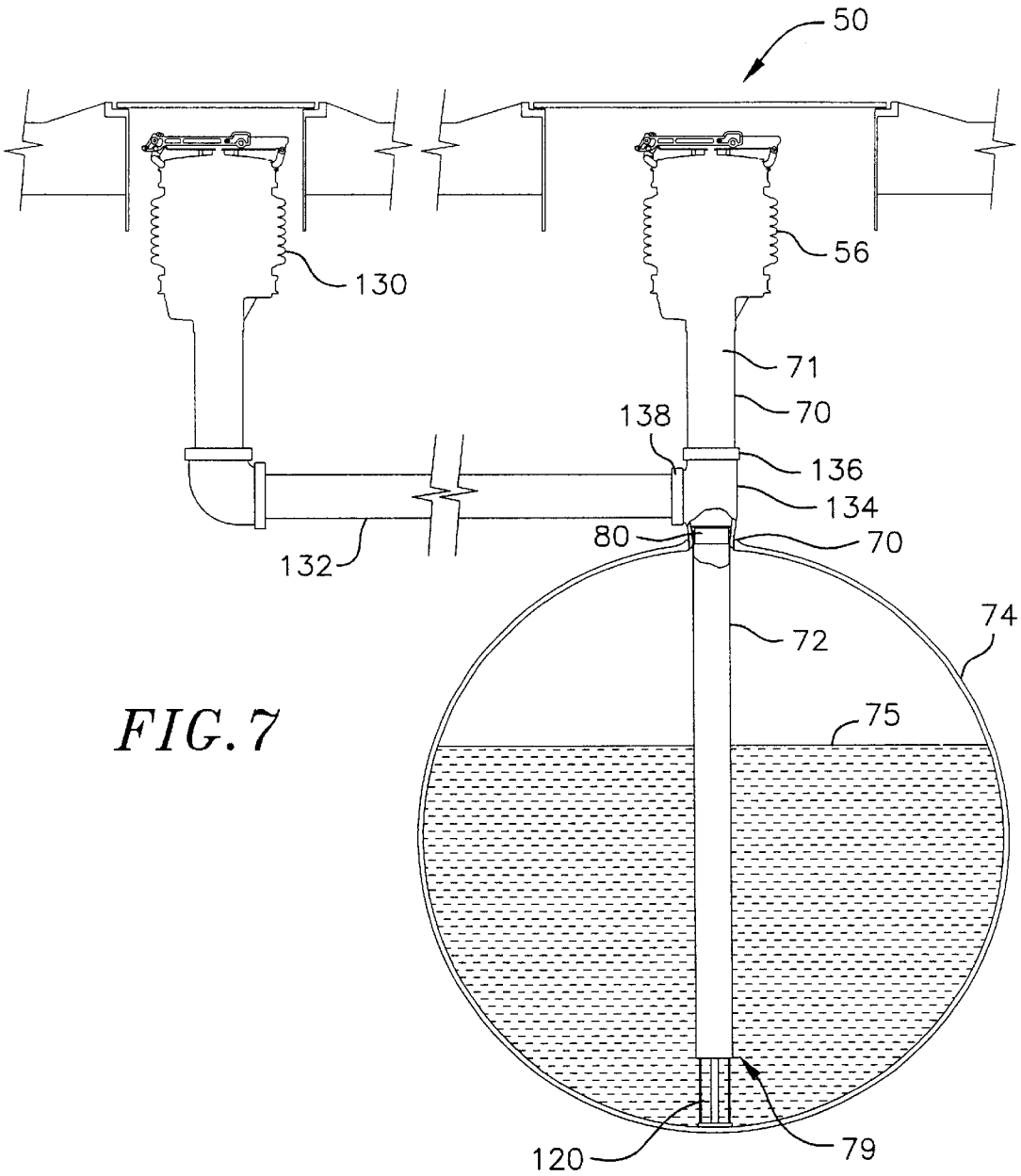
FIG. 7 is a schematic depicting an underground storage tank unit having a remote fill that incorporates a drop tube seal system according to one embodiment of the present invention.

The drop tube may be cut to any length. The drop tube is preferably cut to a length such that the submerged end 79 of the drop tube is sufficiently submerged below the fuel level 75. In a preferred embodiment, the submerged end is positioned no more than 6 inches from the bottom of the tank. However, the gap between the drop tube and the tank bottom may be regulated by various agencies. The present invention can be advantageously used regardless of the particular gap selected or mandated. The drop tube is preferably cut to a length such that fuel entering the UST via the drop tube does not splash or agitate the fuel stored in the UST. As depicted in FIG. 7, a bottom strike protector 120 may be coupled to the bottom floor of the UST to prevent a dip stick used for manual tank gauging from rupturing the bottom of the UST.

The drop tube sealing assembly of the present invention may be easily installed into existing fuel storage tank units. In order to install the system of the present invention, first the riser pipe 70 must be disengaged from the UST threaded bore 85 of the tank inlet. This step may involve partial service station facility demolition if the fill ports are not located in an accessible containment sump, or liquid-tight compartment enclosing a turbine pump and piping connections at the top of an UST.

Next, a sealing compound may be applied to the threaded ends of the pipe nipple 90 before the second end 93 is engaged with the threaded bore 85 in the tank inlet 84. In preferred embodiments, the pipe nipple cooperates with the tank inlet with the female thread portion 96 pointed upward. The riser pipe is then assembled between the first end 92 of the pipe nipple and the outlet end of the direct fill-spill bucket per manufacturers requirements.

Once the containment bucket and the riser pipe are assembled to the UST, the drop tube is then prepped for installation. The drop tube fitting may be bonded to the drop tube pipe per FRP manufacturers instructions. In alternative embodiments, the drop tube is pre-assembled with the drop tube fitting, thus eliminating this step. The drop tube may be cut to a length, such that the drop tube extends to a desired or mandated location below the fuel level. In alternative embodiments, a bottom strike protector may be installed to prevent the drop tube from rupturing the bottom of the UST. After the drop tube is prepped, the drop tube may be inserted into the riser pipe. Sealing compounds are preferably not be applied to the external thread portion 107 of the adaptor fitting during this step to allow adjustment and replacement of the drop tube within the riser pipe.

Figure 6:
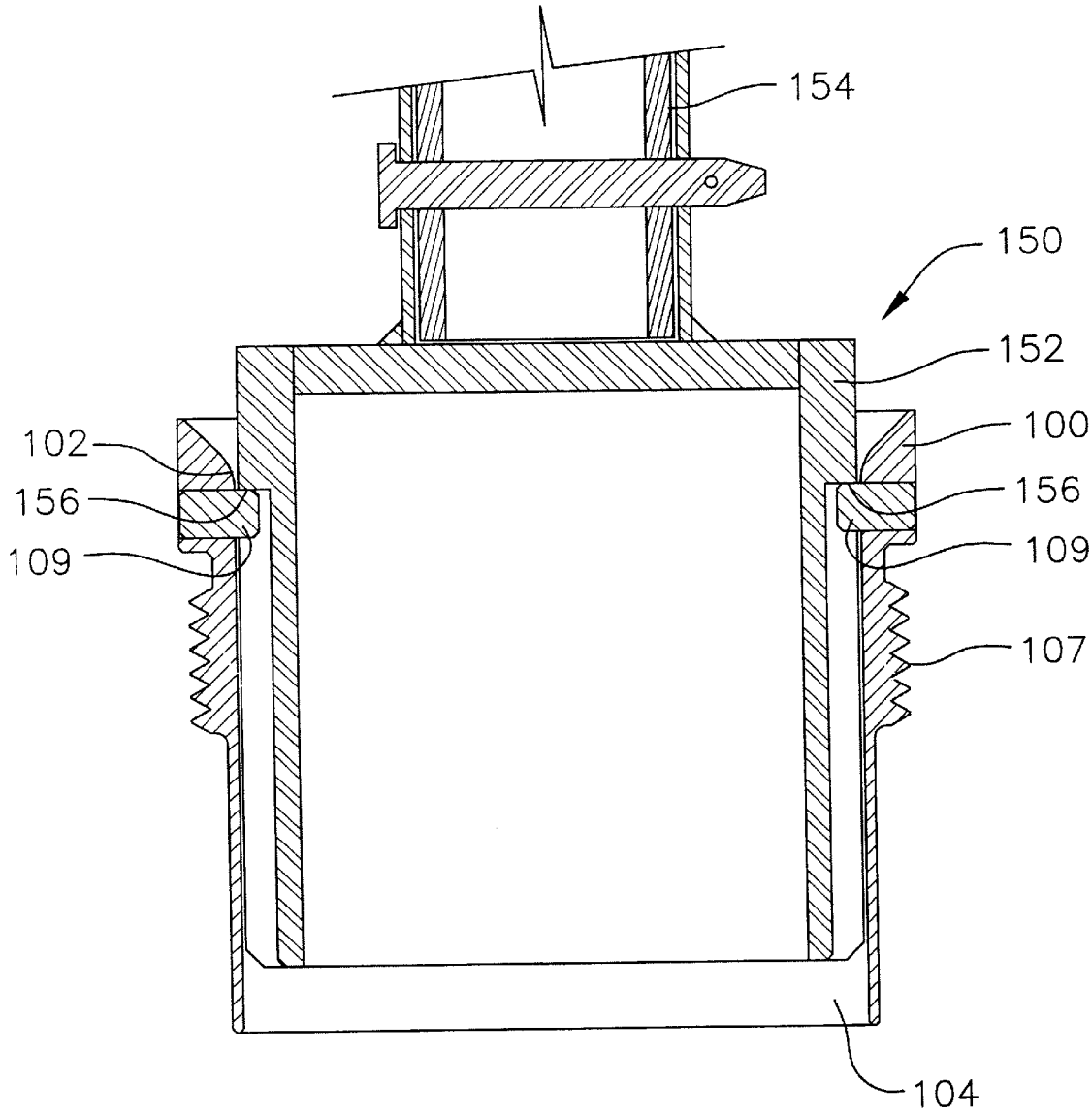
FIG. 6 is a cross-sectional side view of an installation tool coupled to the drop tube adaptor in FIG. 5.

An index installation tool 150, as depicted in FIG. 6, is used to lower the drop tube into adaptor fitting 100 and slowly thread the adaptor fitting into the conduit of the pipe nipple. The installation tool includes a generally cylindrical structure 152 that is fixed to an end of a T-bar handle 154 (partially shown). The cylindrical structure is dimensioned to be received and having a snug fit with the inner surface 102 of the adaptor fitting. The cylindrical structure includes a pair of indexing slots 156 that are machined about its outer diameter, with one of the pair of indexing slots being diametrically opposed from the other. The indexing slots are adapted to receive protruding ends of the adaptor fitting installation pins 109.

As briefly mentioned above, the installation tool 150 is mated with the adaptor fitting orifice 104, such that protruding ends of the indexing pins 109 are received by the indexing slots 156. The snug fit between the outer surface of the cylindrical structure 152 and the adaptor fitting inner surface 102 enables the drop tube to be lowered into the riser pipe via the T-bar handle 154 fixed to the cylindrical structure. Once the threaded portion of the adaptor fitting engages the female thread portion of the pipe nipple, the T-bar may be slowly turned counter clockwise until the O-ring 86 (FIG. 3) is seated with the annular shoulder. Preferably, the fitting is tightened ¼ turn after seating the O-ring.

Upon installation, the installation tool may be removed from the adaptor fitting by applying upward force on the T-bar handle.

In an alternative embodiment, as shown in FIG. 7, the fuel storage unit 50 may include at least one remote fill spill containment bucket 130. In accordance with this embodiment, the remote containment bucket is connected to the main fluid line 71 via fluid piping 132 and a standard pipe tee fitting 134 coupled between the riser pipe and the drop tube seal assembly 80. The pipe tee fitting is a generally T-shaped tube having one in-line leg 136 that is connected to the riser pipe 70, another in-line leg that is connected to the drop tube seal assembly, and a perpendicular leg 138 coupled to the fluid piping. Each of the legs are internally threaded for engaging external threads of the riser pipe, drop tube adaptor nipple and fluid piping, respectively.

In this embodiment, the drop tube seal assembly 80 is positioned along the main fluid line at a location below the remote fill pipe tee 134. As such, tank ullage fuel vapors are sealed and prevented from traveling along the drop tube into the remote fill piping 132 and containment bucket 130.

In a further embodiment, the riser pipe 70 is directly connected to the tank inlet 84. In accordance with this embodiment, the proximal end 76 of the riser pipe is externally threaded in cooperation with the internal threads of the tank inlet's threaded bore 85. An annular seat like that in the adaptor is machined along the inner diameter of the proximal end of the riser pipe. The proximal end also includes an interior female thread section that is disposed along the inner diameter juxtaposed and extending downward from the annular seat.

In this alternative embodiment, the drop tube adaptor fitting 100 may be assembled to the proximal end 76 of the riser pipe by engaging the threaded portion 107 of the adaptor fitting with the female thread section of the proximal end. The annular seat cooperates with an O-ring which fits snugly within the O-ring groove 105 to effect a positive seal between the drop tube 72 and the riser pipe 70. As in the preferred embodiments described above, the land 101 provides an O-ring sealing surface 87 which acts to compress the O-ring against the annular shoulder when the threaded portion is further engaged with the female thread section.

In preferred embodiments of the present invention, the drop tube is described as being disposed within the riser pipe and extending from a position proximate the tank inlet into the UST. However, in some instances, the drop tube may extend within the riser pipe from a position proximate the intake pipe into the UST. According to this embodiment, the open end 78 of the drop tube is positioned proximate the inlet end 65 of the intake pipe. An O-ring grove is machined along the inner diameter of the adaptor nipple and the outer diameter of the drop tube cooperates with an O-ring which fits into the O-ring groove to effect a positive seal between the drop tube and the riser pipe. Thus, fuel vapor is effectively sealed from passing along an annular space defined between the drop tube and the riser pipe and into the direct fill containment bucket.

The preceding description has been presented with reference to presently preferred embodiments of the invention. Workers skilled in the art and technology to which this invention pertains will appreciate that alterations and changes in the described structure may be practiced without meaningfully departing from the principal, spirit and scope of this invention.

Accordingly, the foregoing description should not be read as pertaining only to the precise structures described and illustrated in the accompanying drawings, but rather should be read consistent with and as support to the following claims which are to have their fullest and fair scope.

What is claimed is:

1. A unit for storing gasoline comprising:

an underground storage tank for storing the gasoline, the storage tank having an inlet at the top of the tank;

a riser pipe extending from the inlet towards the surface for communicating gasoline between a fuel source and the storage tank;

a drop tube concentrically disposed within the riser pipe that extends into the storage tank; and a seal between the riser pipe and the drop tube for containing gasoline vapors, the seal being located proximate the inlet.

2. The unit of claim 1 further comprising a first containment bucket having an open top for receiving gasoline and a bottom having a port, wherein the riser pipe extends between the port and the inlet for communicating gasoline between the containment bucket and the storage tank.

3. The unit of claim 2 further comprising a second containment bucket connected to and in communication with the riser pipe, the second containment bucket being remotely located from the first containment bucket, the seal being disposed at a location beneath the connection between the second containment bucket and riser pipe.

4. The unit of claim 1, wherein the drop tube extends from a position proximate ground level to a location within the underground storage tank.

5. The unit of claim 1, wherein the drop tube extends from a position proximate the seal to a location within the underground storage tank.

6. The unit of claim 1, wherein the seal comprises a system that includes a standard pipe nipple coupled between the riser pipe and the inlet, a drop tube adapter fitting concentrically disposed within the pipe nipple, and an O-ring disposed between the adapter fitting and the pipe nipple.

7. The unit of claim 1, wherein the seal is an O-ring that is received by O-ring groove located at an end of the riser pipe.

8. A unit for storing gasoline comprising:

a first containment bucket having an open top for receiving gasoline and a bottom having a port;

an underground storage tank remotely located from the first containment bucket for storing the gasoline, the storage tank having an inlet at the top of the tank;

a riser pipe extending between the port and the inlet for communicating gasoline between the first containment bucket and the storage tank;

a fitting disposed along the riser pipe between the storage tank and the first containment bucket, the fitting being coupled to a remote containment bucket;

a drop tube concentrically disposed within the riser pipe that extends into the storage tank; and a seal between the riser pipe and the drop tube for containing gasoline vapors, the seal being located below the fitting.

9. The unit of claim 8, wherein the remote containment bucket is connected to and in communication with the riser pipe, remote containment bucket being remotely located from the first containment bucket, the seal being disposed at a location beneath the connection between the remote containment bucket and riser pipe.

10. The unit of claim 8, wherein the drop tube extends from a position proximate ground level to a location within the underground storage tank.

11. The unit of claim 8, wherein the drop tube extends from a position proximate the seal to a location within the underground storage tank.

12. The unit of claim 8, wherein the seal comprises a system that includes a standard pipe nipple coupled between the riser pipe and the inlet, a drop tube adapter fitting concentrically disposed within the pipe nipple, and an O-ring disposed between the adapter fitting and the pipe nipple.

13. The unit of claim 8, wherein the seal is an O-ring that is received by O-ring groove located at an end of the riser pipe.

14. A drop tube sealing assembly comprising:

a riser tube having a proximal end, the proximal end having internal threads;

an underground storage tank spaced apart from the proximate end, the storage tank having a threaded inlet;

a standard pipe nipple having a first end in cooperation with the proximal end, an opposite end in cooperation with the threaded inlet, and an annular inner surface that forms a conduit, the inner surface comprising a female thread section;

a drop tube adapter fitting concentrically disposed within the pipe nipple, the adapter fitting having an outer surface containing external threads in cooperation with the female thread section;

a seal disposed between the adapter fitting and the pipe nipple; and a drop tube having a open end coupled to the adapter fitting.

15. A method of preventing vapors from passing from an underground storage tank into the atmosphere, the method comprising:

providing a riser pipe that is connectable and upwardly extends from the top of the underground storage tank into the atmosphere;

concentrically disposing a drop tube within the riser pipe, wherein the riser pipe extends into the underground storage tank; and providing a seal between the riser pipe and the drop tube at a location proximate the top of the underground storage tank.

* * * * *